US009514665B2

(12) United States Patent
Lee et al.

(10) Patent No.: US 9,514,665 B2
(45) Date of Patent: Dec. 6, 2016

(54) TESTING DEVICE, AND TESTING METHOD FOR THE LINE AND ONE SHEET USING THE TESTING DEVICE

(71) Applicant: Samsung Display Co., Ltd., Yongin (KR)

(72) Inventors: Kwang-Sae Lee, Yongin (KR); Jeong-Geun Yoo, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 303 days.

(21) Appl. No.: 14/190,786

(22) Filed: Feb. 26, 2014

(65) Prior Publication Data

US 2015/0008937 A1 Jan. 8, 2015

(30) Foreign Application Priority Data

Jul. 5, 2013 (KR) ..... 10-2013-0079281

(51) Int. Cl.
*G09G 3/00* (2006.01)
*G09G 3/32* (2016.01)

(52) U.S. Cl.
CPC ..... *G09G 3/006* (2013.01); *G09G 3/3225* (2013.01); *G09G 2310/0297* (2013.01)

(58) Field of Classification Search
CPC ..... G09G 3/006; G09G 3/3225; G09G 2310/0297
USPC ..... 324/539
See application file for complete search history.

(56) References Cited

U.S. PATENT DOCUMENTS

2004/0095549 A1* 5/2004 Moon ..... G02F 1/1345 349/192
2008/0054798 A1* 3/2008 Jeong ..... G09G 3/006 313/504
2009/0225009 A1* 9/2009 Ka ..... G09G 3/3233 345/76

FOREIGN PATENT DOCUMENTS

KR 10-2007-0066261 6/2007
KR 10-2007-0110745 11/2007
KR 10-2011-0037638 4/2011

* cited by examiner

*Primary Examiner* — Jermele M Hollington
*Assistant Examiner* — Khristopher Yodichkas
(74) *Attorney, Agent, or Firm* — H.C. Park & Associates, PLC

(57) ABSTRACT

A test device for a display device including a plurality of demultiplexing switches connected to a plurality of data lines in accordance with the present invention includes: a one-sheet test device configured to include a plurality of control switches connected to the demultiplexing switches through a plurality of wires; and a wire test device configured to transmit wire test signals for detecting defects in the wires to a pad connected to the control switches. The wire test device transmits the wire test signals to the pad to detect defects in first wires of the wires and then detect defects in remaining second wires thereof, and the first wires and the second wires are alternatively disposed below the demultiplexing switches to constitute paths for signals transmitted to the demultiplexing switches.

11 Claims, 9 Drawing Sheets

TESTING DEVICE, AND TESTING METHOD FOR THE LINE AND ONE SHEET USING THE TESTING DEVICE

CROSS-REFERENCE TO RELATED APPLICATION

This application claims priority from and the benefit of Korean Patent Application No. 10-2013-0079281, filed on Jul. 5, 2013, which is hereby incorporated by reference for all purposes as if fully set forth herein.

BACKGROUND

Field

Exemplary embodiments of the present invention relate to a one-sheet test device and a method of testing a wire and one sheet using the same.

Discussion of the Background

In general, display panels of organic light emitting displays are formed and scribed on one substrate (hereinafter, a one-sheet substrate) to be divided into individual panels. Before being cut and divided from the one-sheet substrate, the display panels on the one-sheet substrate are subjected to a lighting process, a test process, or an aging process in a unit of a display panel.

Specifically, in an active matrix display panel, a circuit unit thereof is tested before an organic light emitting element is deposited on the display panel on the one-sheet substrate after a manufacturing process is started. However, conventionally, there is no electrical test on the one-sheet substrate. Further, errors on the one-sheet substrate are determined by a visual test, which may not always be accurate. A test has recently been introduced for the one-sheet substrate. Specifically, this test is an electrical test which is performed on the one-sheet substrate through direct contact with a chip-on-glass (COG) pad. However, an error in the display panel may be caused by damage to a COG pad. Arrangement of a multiplexing (MUX) circuit below the bump and the forming of a COG pad connected to the multiplexing circuit during the testing of the one-sheet substrate may also cause a problem.

The above information disclosed in this Background section is only for enhancement of understanding of the background of the invention and, therefore, it may contain information that does not form the prior art that is already known in this country to a person of ordinary skill in the art.

SUMMARY

Exemplary embodiments of the present invention provide a device and a method for testing one sheet and a spider wire.

Additional features of the invention will be set forth in the description which follows, and in part will be apparent from the description, or may be learned by practice of the invention.

An exemplary embodiment discloses a test device for a display device, including: demultiplexing switches connected to data lines, including a one-sheet test device configured to include control switches connected to the demultiplexing switches through wires; and a wire test device configured to transmit wire test signals for detecting defects in the wires to a pad connected to the control switches. The wire test device is configured to transmit the wire test signals to the pad to detect defects in first wires of the wires, and then to detect defects in remaining second wires thereof. The first wires and the second wires are alternatively disposed below the demultiplexing switches to constitute paths for signals transmitted to the demultiplexing switches.

An exemplary embodiment of the present invention also discloses a wire test method in which a test device tests whether defects are generated in wires of a display device, including: supplying wire test signals to a pad of a one-sheet test device by turning on a test switch; turning on one of a first group including one or more first control switches connected to first wires and a second group including one or more second control switches connected to second wires; and detecting whether defects are generated in the wires according to a light emitting state of a pixel array of data lines connected to wires of the control switches of the turned-on group.

An exemplary embodiment of the present invention also discloses a one-sheet test method in which a test device tests an error in a display device, including: turning off a test switch of a wire test device; supplying probe test data to a pad of a one-sheet test device; turning on an $n^{th}$ control switch of the one-sheet test device which is connected to an $n^{th}$ wire; sequentially turning on a plurality of demultiplexing switches connected to the $n^{th}$ wire; and detecting an error according to a light emitting state of a pixel array connected to the demultiplexing switches.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate exemplary embodiments of the invention, and together with the description serve to explain the principles of the invention.

DETAILED DESCRIPTION OF THE ILLUSTRATED EMBODIMENTS

Figure 1:
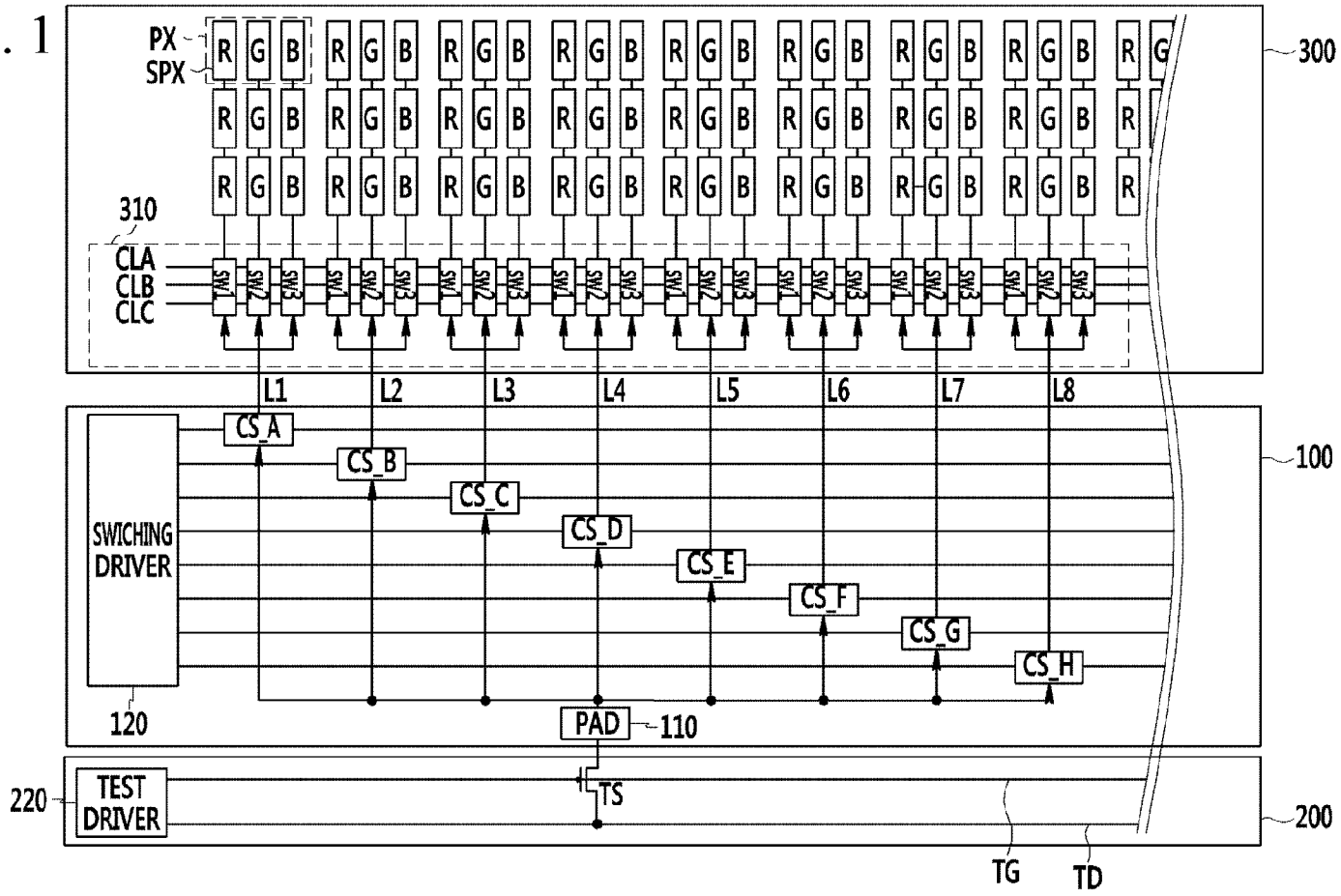
FIG. 1 shows a circuit configuration of a display device including a test device according to an exemplary embodiment of the present invention.

The invention is described more fully hereinafter with reference to the accompanying drawings, in which exemplary embodiments of the invention are shown. This invention may, however, be embodied in many different forms and should not be construed as limited to the exemplary embodiments set forth herein. Rather, these exemplary embodiments are provided so that this disclosure is thorough, and will fully convey the scope of the invention to those skilled in the art. In the drawings, the size and relative sizes of elements may be exaggerated for clarity. Like reference numerals in the drawings denote like elements.

Throughout this specification and the claims that follow, when an element is referred to as "coupled" to another element, the element may be "directly coupled" to the other element or "electrically coupled" to the other element through a third element. In contrast, when an element is referred to as being "directly coupled" to another element, there are no intervening elements present. It will be understood that for the purposes of this disclosure, "at least one of X, Y, and Z" can be construed as X only, Y only, Z only, or any combination of two or more items X, Y, and Z (e.g., XYZ, XYY, YZ, ZZ). In addition, unless explicitly described to the contrary, the word "comprise" and variations such as "comprises" or "comprising" will be understood to imply the inclusion of stated elements but not the exclusion of any other elements.

Hereinafter, a test device and a method of testing a wire and one sheet using the same in accordance with an exemplary embodiment of the present invention will be described with reference to the accompanying drawings.

FIG. 1 shows a circuit configuration of a display device including a test device. For better understanding and ease of description, only parts of a display panel, i.e., a plurality of pixels arranged in 3 rows connected to 8 spider wires L1 to L8, are shown. As for a demultiplexer, a one-sheet test device, and a wire test device, only parts connected to the 8 spider wires L1 to L8 are shown.

Referring to FIG. 1, the display device includes a one-sheet test device 100, a wire test device 200, and a display unit 300.

The display unit 300 includes a plurality of pixel arrays in which pixels are arranged, and a demultiplexer 310 connected to each of the pixel arrays. The demultiplexer 310 is located between a plurality of wires and a plurality of data lines to connect the data lines to the wires. The demultiplexer 310 includes a plurality of demultiplexing switches connected to the data lines, respectively.

The wires, which are spider wires (hereinafter simply referred to as wires) formed with a distance therebetween ranging from 5 to 10 μm like a spider web, are often short-circuited or open-circuited as a result of foreign particles or the like after a manufacturing process is started. The one-sheet test device 100 serves to detect defects in the pixels or the demultiplexer 310 connected to the wires.

The wire test device 200 is connected to a pad 110 of the one-sheet test device 100 to detect defects in the wires. Specifically, the wire test device 200 transmits wire test signals to the pad 110 of the one-sheet test device 100 to detect defects in first wires L1, L3, L5, and L7, and then detect defects in second wires L2, L4, L6, and L8. Herein, the first wires L1, L3, L5, and L7 and the second wires L2, L4, L6, and L8 are alternatively disposed below the demultiplexer 310 of the display unit 300 to constitute paths for signals transmitted to the demultiplexer 310.

The one-sheet test device 100 includes a switching driver 120 and a plurality of control switches CS_A to CS_H. The switching driver 120 is connected to the control switches CS_A to CS_H and turns the control switches CS_A to CS_H on and off by applying voltages to corresponding control switches.

When the wire test device 200 tests the wires, the switching driver 120 alternately turns on and off first control switches CS_A, CS_C, CS_E, and CS_G and second control switches CS_B, CS_D, CS_F, and CS_H.

Herein, the first control switches CS_A, CS_C, CS_E, and CS_G are not adjacent to each other. The remaining control switches of the control switches CS_A to CS_H, except for the first control switches CS_A, CS_C, CS_E, and CS_G, are the second control switches CS_B, CS_D, CS_F, and CS_H. The second control switches CS_B, CS_D, CS_F, and CS_H are also not adjacent to each other.

For example, the first control switches CS_A, CS_C, CS_E, and CS_G are odd-numbered switches, and the second control switches CS_B, CS_D, CS_F, and CS_H are even-numbered switches. Further, the switching driver 120 may apply voltages to the control switches CS_A to CS_H such that the control switches CS_A to CS_H are individually turned on and off.

The control switches CS_A to CS_H are disposed between the pad 110 and the wires L1 to L8. The wire test signals or one-sheet test signals are transferred to the wires L1 to L8 connected to corresponding control switches CS_A to CS_H through the control switches CS_A to CS_H.

The wire test device 200 includes a test driver 220, a test data line TD, a test gate line TG, and a test switch TS. The test driver 220 supplies wire test signals for testing the wires to the test data line TD.

The test data line TD supplies the wire test signals to the pad 110 of the one-sheet test device. The test gate line TG is connected to a gate electrode of the test switch TS to apply test gate signals to the test switch TS. The test driver 220 turns the test switch TS on and off by supplying the test gate signals to the test gate line TG to thereby transmit the wire test signals of the test data line TD to the pad 110 of the one-sheet test device.

The gate electrode of the test switch TS is connected to the test gate line TG to receive the test gate signals. A source electrode thereof and a drain electrode thereof are respectively connected to the test data line TD and the pad 110, to transmit the wire test signals to the pad 110. In other words, the wire test device 200 is connected to the pad 110 of the one-sheet test device 100 to transmit one wire test signal to the pad 110 according to one test gate signal.

Accordingly, the wire test device 210 of the present exemplary embodiment provides a capability of testing the wires by using one test gate line TG and one test data line TD.

The display unit 300 includes pixel arrays in which pixels are arranged, and the demultiplexer 310 connected to each of the pixel arrays. The demultiplexer 310 is located between a plurality of wires L1 to L8 and a plurality of data lines. The wires L1 to L8 are connected to the control switches CS_A to CS_H to transmit the wire test signals or the one-sheet test signals, inputted into the control switches CS_A to CS_H, to each of the demultiplexing switches SW1 to SW3.

The demultiplexing switches SW1 to SW3 are turned on and off by control lines CLA to CLC to transmit the wire test signals or the one-sheet test signals, transmitted from the wires L1 to L8, to the pixel arrays.

Figure 2:
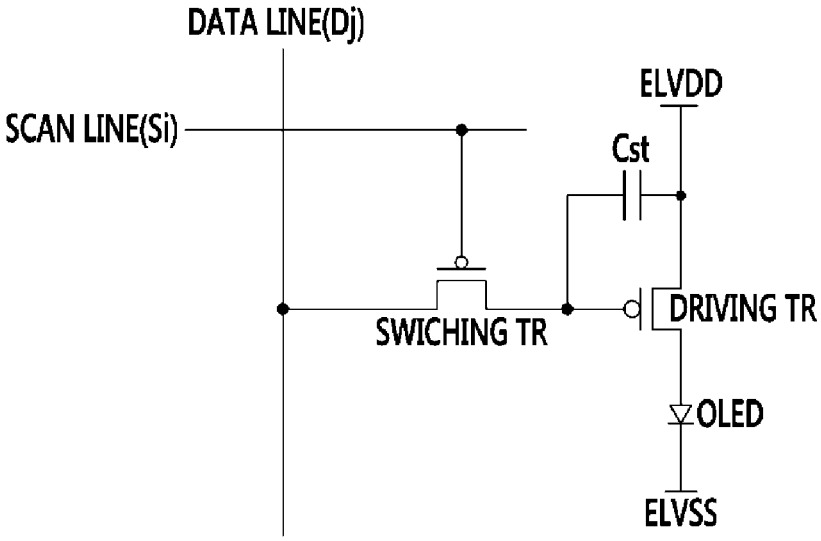
FIG. 2 shows a schematic diagram of a pixel in accordance with an exemplary embodiment of the present invention.

FIG. 2 shows a schematic diagram of one sub-pixel in accordance with an exemplary embodiment of the present invention, but the present invention is not limited thereto. As shown in FIG. 1, one pixel PX includes three sub-pixels SPX displaying red, green, and blue colors R, G, and B. An example of one sub-pixel SPX is shown in FIG. 2, which is assumed to be a pixel connected to an $i^{th}$ scan line Si and a $j^{th}$ data line Dj. As shown in FIG. 2, the sub-pixel includes a switching transistor (switching TR), a driving transistor (driving TR), a capacitor Cst, and an organic light emitting element (OLED). The switching TR includes a gate electrode connected to a scan line Si, a first electrode connected to a data line Dj, and a second electrode connected to the gate electrode of the driving TR. The driving TR includes a source electrode connected to a voltage ELVDD, a drain electrode connected to an anode of the OLED, and the gate electrode connected to the switching TR. The capacitor Cst is connected between the gate electrode and the source electrode of the driving TR, and a cathode of the OLED is connected to the voltage ELVSS.

When a scan signal transmitted from through the scan line has a low level, the switching TR is turned on and the capacitor Cst is charged by a data signal transmitted through the data line. A gate voltage of the driving TR is constantly maintained by the capacitor Cst until next scanning, and a driving current is generated according to a difference of the gate-source voltage of the driving TR. The OLED emits light according to the driving current.

The demultiplexer 310 transmits a plurality of data signals, transmitted through the wires L1 to L8, to corresponding data lines through a plurality of switches. The demultiplexer 310 includes a plurality of demultiplexing switches sw1, sw2, and sw3, and control lines CLA, CLB, and CLC.

When wires L1 to L8 are tested for defects, all the demultiplexing switches sw1, sw2, and sw3 are controlled to be turned on. When one sheet is tested, e.g., when the demultiplexer 310 is tested for defects, the demultiplexing switches sw1, sw2, and sw3 are controlled to be turned on individually.

Figure 3:
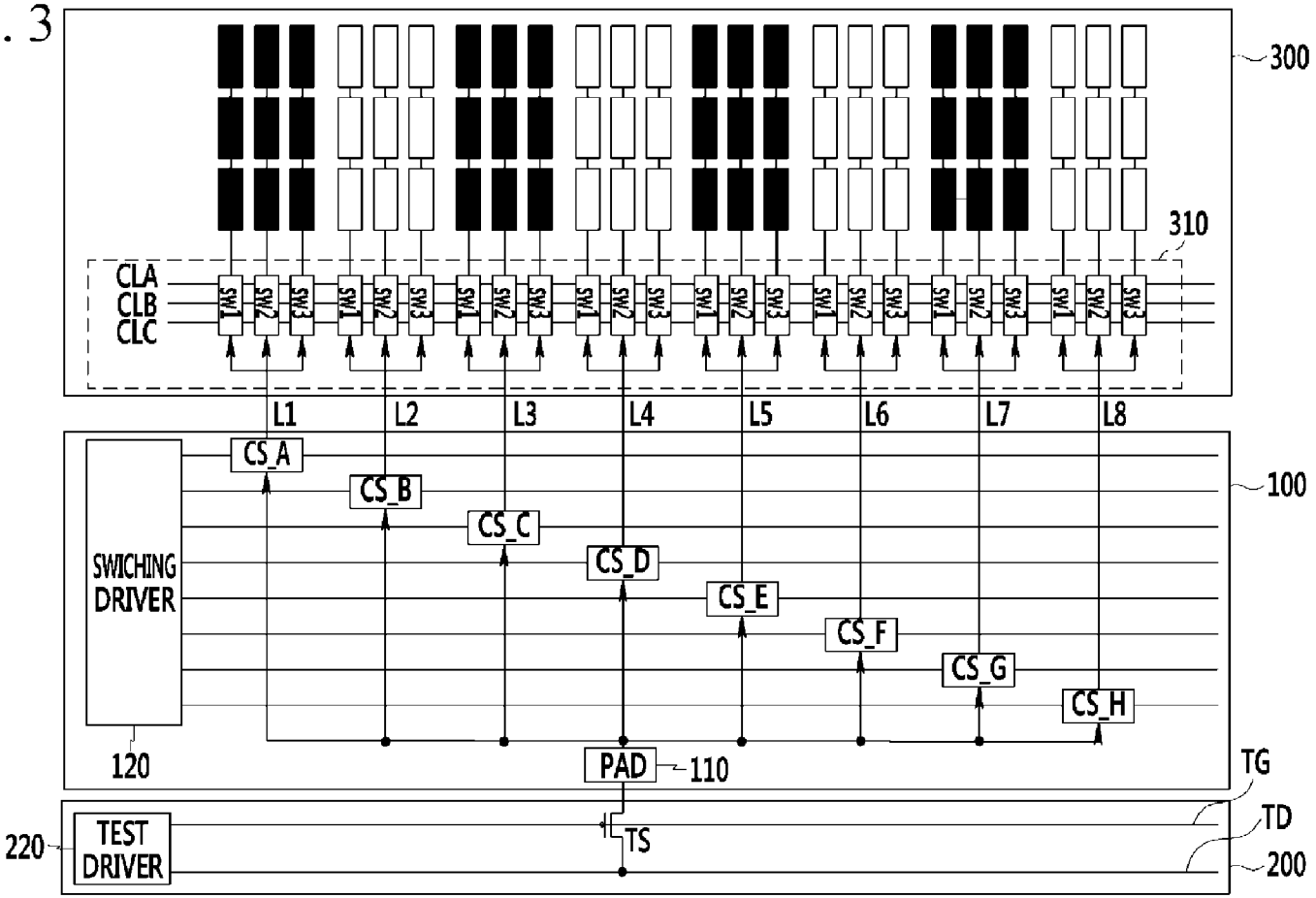
FIG. 3 shows a display state of the display device of FIG. 1 according to an operation of the test device for detecting a first wire.
Figure 4:
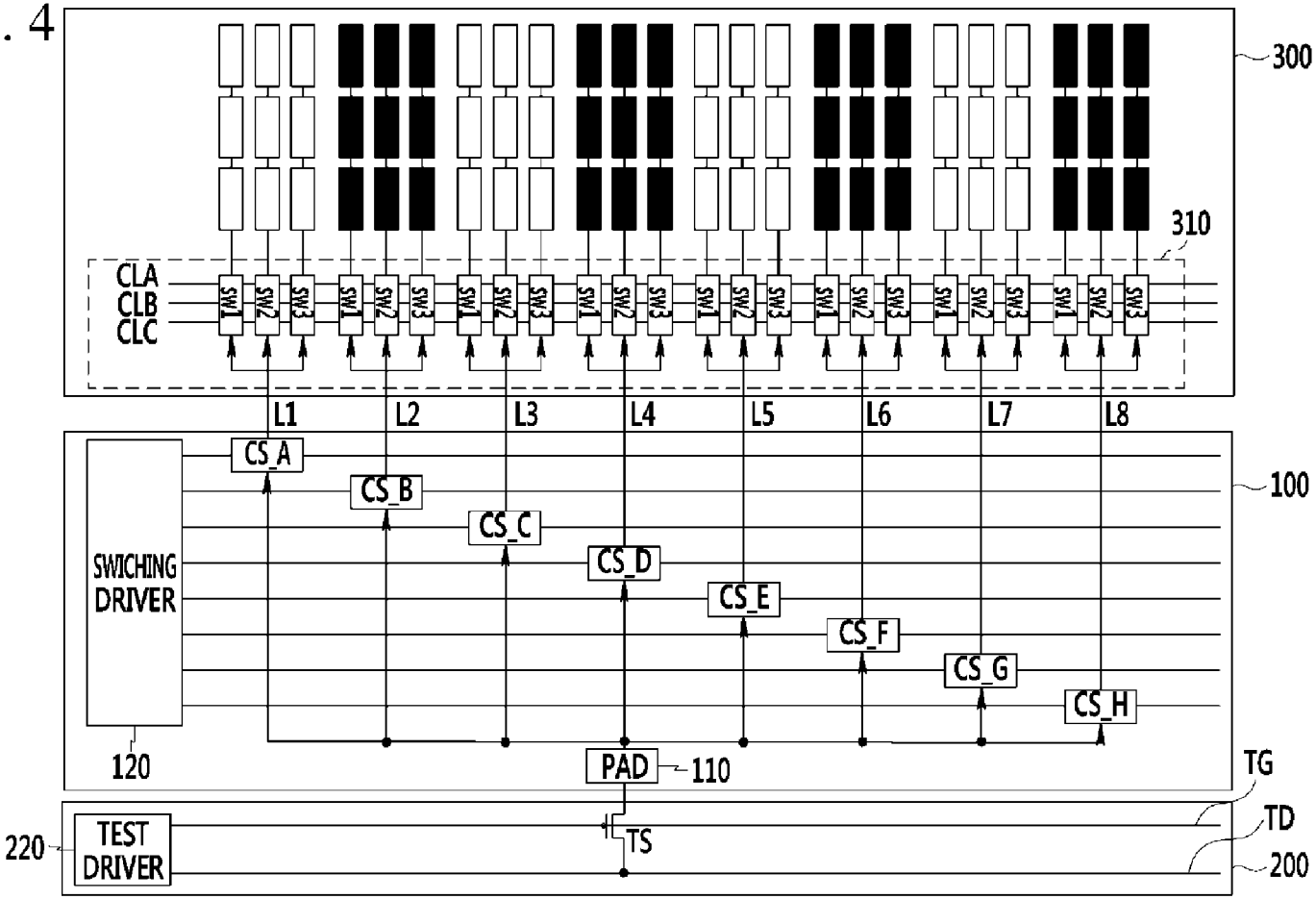
FIG. 4 shows a display state of the display device of FIG. 1 according to an operation of the test device for detecting a second wire.

FIG. 3 shows a display state of the display device according to an operation of the test device for detecting whether defects are generated in first wires L1, L3, L5, and L7, and FIG. 4 shows a display state of the display device according to an operation of the test device for detecting whether defects are generated in second wires L2, L4, L6, and L8.

Before a wire test is initiated, all pixels of the display panel are initialized with a light-emitting state of a full-white grayscale, for example. Alternatively, another grayscale may be used instead of the full-white grayscale. For example, when black grayscale data is transferred to a test target wire, another grayscale may be an upper grayscale that can be distinguished from the black grayscale.

When the test gate line TG of the wire test device 200 is turned on, the first control switches CS_A, CS_C, CS_E, and CS_G of the one-sheet test device 100 are turned on, and the second control switches CS_B, CS_D, CS_F, and CS_H are turned off.

Referring to FIG. 3, black data is transmitted to the first wires L1, L3, L5, and L7 respectively connected to the first control switches CS_A, CS_C, CS_E, and CS_G. When there is no short- or open-circuit of any of the wires L1 to L8, pixels of the pixel array connected to the first wires L1, L3, L5, and L7 through the demultiplexing switches are displayed as black. Pixels of the pixel array connected to the second wires L2, L4, L6, and L8 through the demultiplexing switches are displayed as white.

Hereinafter, no short-circuit or open-circuit of any of the wires L1 to L8 is defined as a normal state.

When the test gate line TG of the wire test device 200 is turned on, the second control switches CS_B, CS_D, CS_F, and CS_H of the one-sheet test device 100 are turned on and the first control switches CS_A, CS_C, CS_E, and CS_G are turned off.

Referring to FIG. 4, black data is transmitted to the first wires L1, L3, L5, and L7 respectively connected to the second control switches CS_B, CS_D, CS_F, and CS_H. The pixels of the pixel array connected to the second wires L2, L4, L6, and L8 through the demultiplexing switches are then displayed as black. The pixels of the pixel array connected to the first wires L1, L3, L5, and L7 through the demultiplexing switches are displayed as white.

Figure 5:
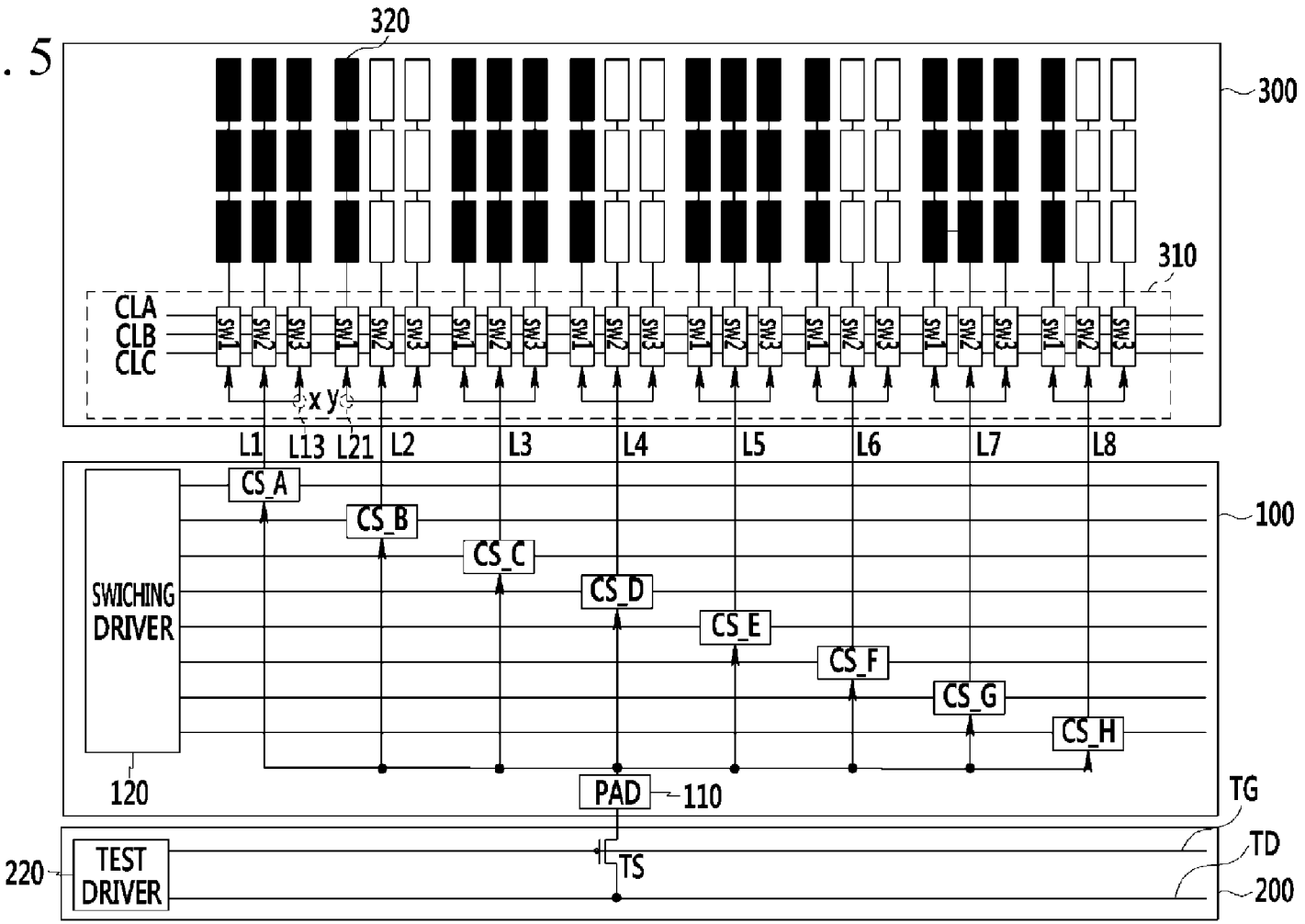
FIG. 5 shows a display state of the display device of FIG. 1 when a short-circuit is generated in a wire.

As shown in FIG. 5, when a short-circuit is generated between a wire L13 of a region x to which black data is transmitted and a wire L21 of a region y adjacent to the region x, a line 320 connected to the wire L21 of the region y to which no black data is transmitted is displayed as black.

Further, a line connected to the turned-off control switch CS_B is displayed as white. However, when the wire L2 is open-circuited, all three pixel arrays connected to the wire L2 are displayed as white. Accordingly, it is difficult to recognize whether the wire L21 of the region y connected to the turned-off control switch CS_B is open-circuited.

Therefore, on and off states of the first wires L1, L3, L5, and L7 and the second wires L2, L4, L6, and L8 are alternately switched to test open-circuit states of the wires, as shown in FIG. 3 and FIG. 4. Thus, the test device of the present exemplary embodiment can sense the normal states of the wires L1 to L8 through such display states shown in FIG. 3 and FIG. 4.

Hereinafter, abnormal display states in which a short- or open-circuit is generated in the wires will be described with FIG. 5 to FIG. 7.

FIG. 5 shows a display state of the display device when a short-circuit is generated.

In a case that the short-circuit is in the wire L13 of the region x and t the wire L21 of the region y, black data is transmitted to the pixels of the pixel array connected to the switch sw1 connected to the wire L21 of the region y when the first wires L1, L3, L5, and L7 are tested. Accordingly, as shown in FIG. 5, even when the control switch CS_B is turned off, black data is transmitted to the wire L21 of the region y and the pixels of the pixel array 320 are displayed as black. Accordingly, it is possible to sense a wire error caused by a short-circuit.

Figure 6:
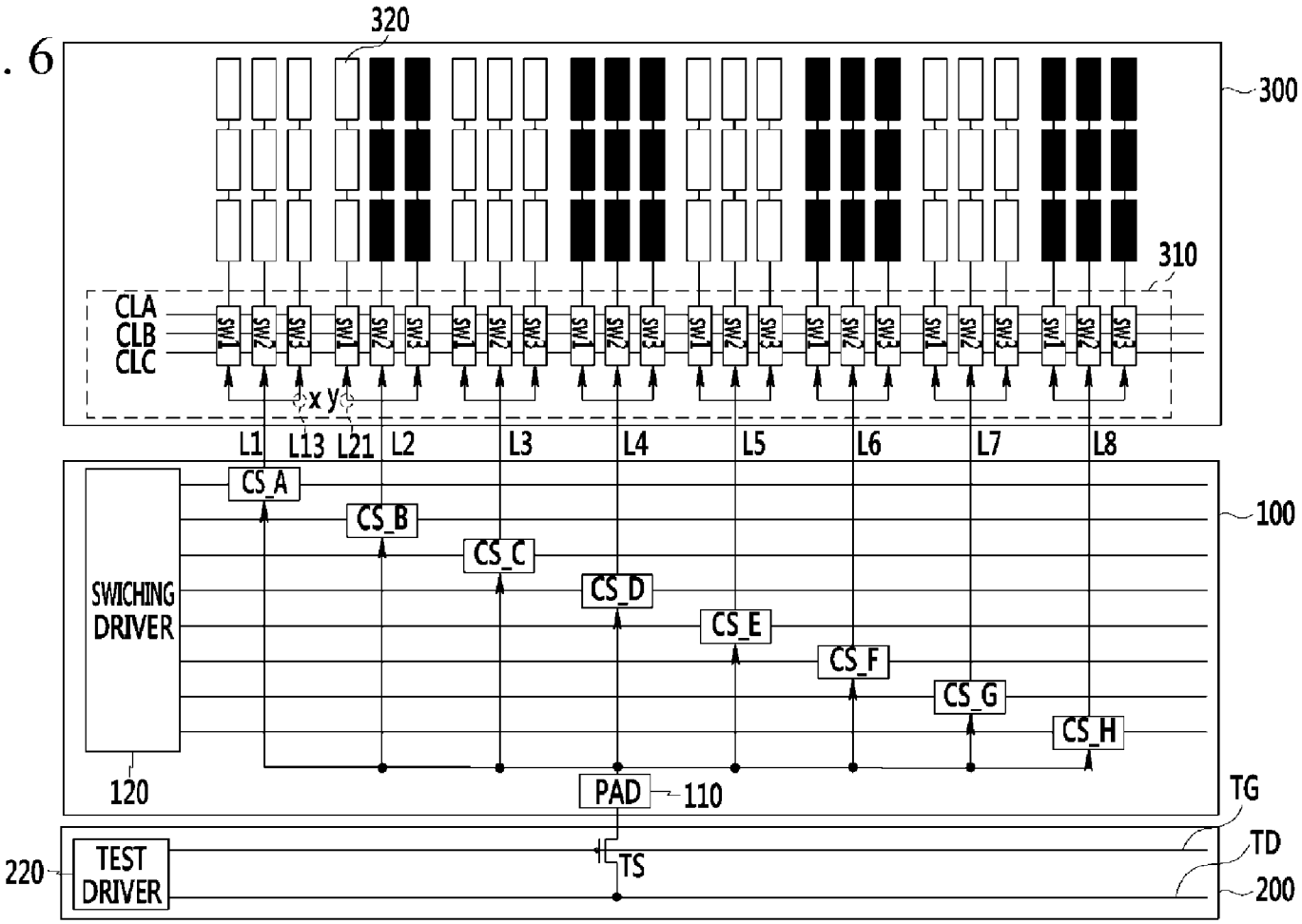
FIG. 6 shows a display state of the display device of FIG. 1 when an open-circuit is generated in a wire.

FIG. 6 shows a display state of the display device when an open-circuit wire defect is generated.

When testing is performed to detect whether defects are generated in the first wires L1, L3, L5, and L7, if the wire L21 of the region y is open-circuited, the pixels of the pixel array 320 connected to the switch sw1 of the wire L21 are displayed as white, whereby it is difficult to recognize whether or not the wire L21 of the region y is open-circuited.

When testing is performed to determine whether defects are generated in the second wires L2, L4, L6, and L8, black data is transmitted to the pixels of the pixel array connected to the switch sw1 of the wire L21 of the region y. However, because the wire L21 of the region y is open-circuited, no black data is transmitted to the pixel array connected thereto.

Accordingly, as shown in FIG. 6, even when the control switch CS_B is turned on, no black data is transmitted to the wire L21 of the region y, and the pixels of the pixel array connected to the switch sw1 of the wire L21 are displayed as white. Therefore, it is possible to sense such wire error caused by an open-circuit of the wire L21 of the region y.

Figure 7:
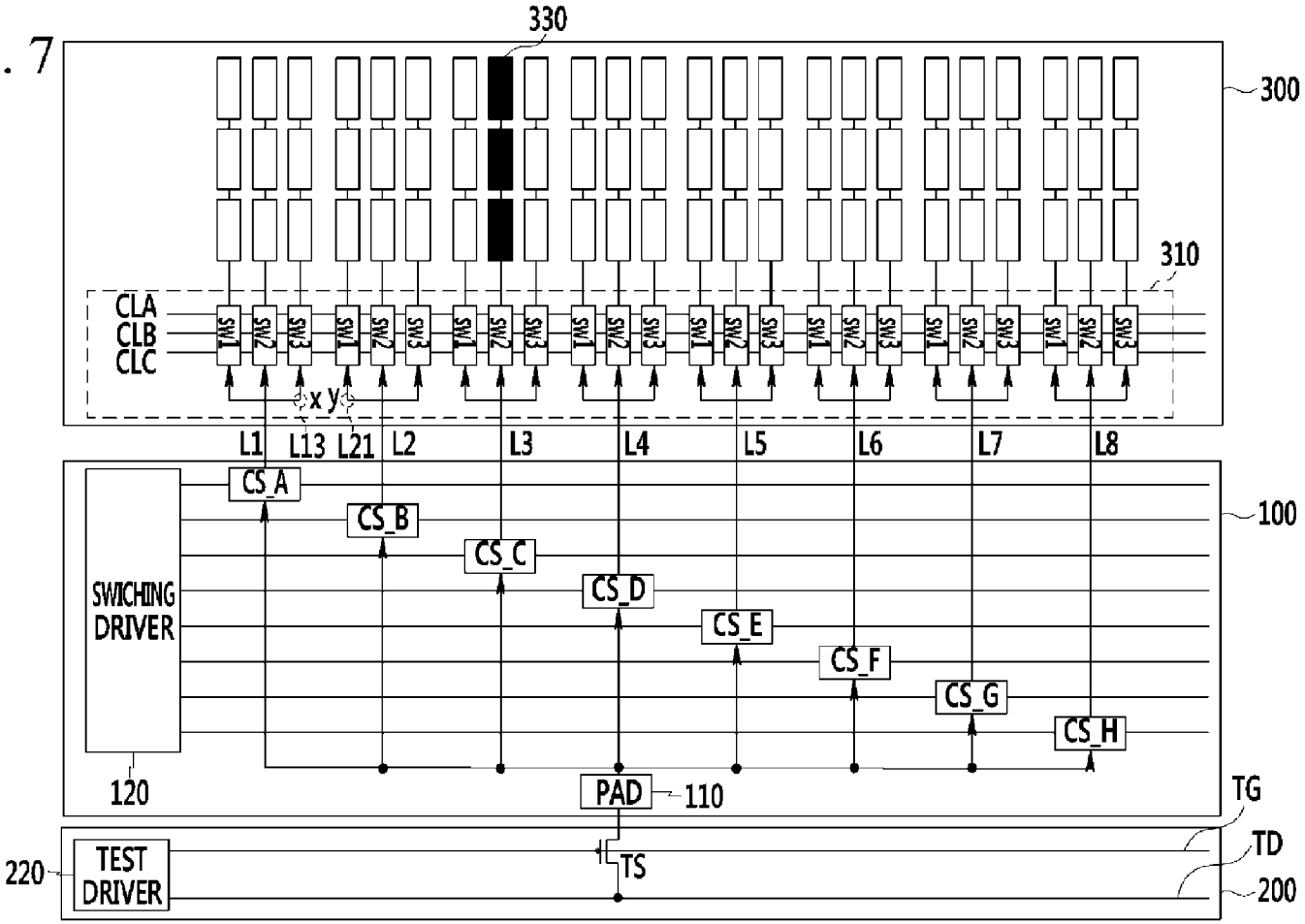
FIG. 7 shows a display state of the display device of FIG. 1 according to an operation of the test device for testing one sheet.

FIG. 7 shows a display state of the display device according to an operation of the test device for testing one sheet.

Before a wire test is initiated, all pixels of the display panel are initialized in a light emitting state of a full-white grayscale. This is an example of such initialization for the wire test. Alternatively, another grayscale may be used instead of the full-white grayscale. For example, when black grayscale data is transferred to a test target wire, the other grayscale may be an upper grayscale that can be distinguished from the black grayscale.

When one sheet is tested, the test device turns off the test switch TS of the wire test device 200 and sequentially turns on the control switches CS_A to CS_H of the one-sheet test device 100 and the demultiplexing switches sw1, sw2, and sw3 connected thereto.

For example, as shown in FIG. 7, the control switch CS_C is turned on, and the demultiplexing switch sw2 connected to the wire L3 is turned on to transmit data. FIG. 7 shows that pixels of the pixel array connected to the wire L3 and the demultiplexing switch sw2 of the wire L3 display black.

Figure 8:
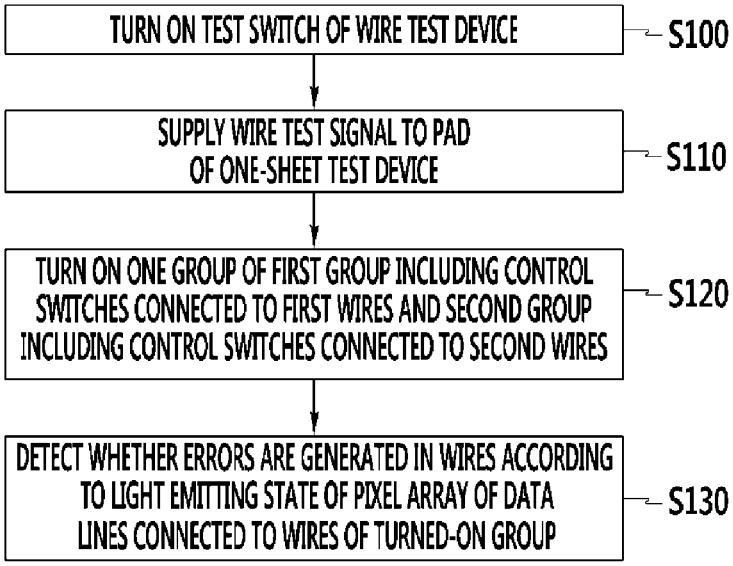
FIG. 8 is a flowchart showing a wire testing operation in accordance with an exemplary embodiment of the present invention.

FIG. 8 is a flowchart showing a wire testing operation in accordance with an exemplary embodiment of the present invention.

A wire test method by which a test device tests whether defects are generated in wires of a display device will be described as follows. First, the test switch TS of the wire test device 200 is turned on by supplying gate control signals to the test gate line TG (S100).

Once the test switch TS is turned on, wire test signals of the test gate line TD are supplied to the pad 110 of the one-sheet test device (S110).

The test device turns on the first control switches CS_A, CS_C, CS_E, and CS_G connected to the first wire L1, L3, L5, and L7 and turns off the second control switches CS_B, CS_D, CS_F, and CS_H (S120).

When the first control switches CS_A, CS_C, CS_E, and CS_G are turned on, the wire test signals are transmitted to only the first control switches CS_A, CS_C, CS_E, and CS_G, and defects in the first wires L1, L3, L5, and L7 are detected through light emitting states of the pixels connected to the data lines of the first wires L1, L3, L5, and L7 corresponding to the first control switches CS_A, CS_C, CS_E, and CS_G (S130).

Further, the test device turns on the second control switches CS_B, CS_D, CS_F, and CS_H and turns off the first control switches CS_A, CS_C, CS_E, and CS_G connected to the first wires L1, L3, L5, and L7 (S120).

Similarly, when the second control switches CS_B, CS_D, CS_F, and CS_H are turned on, the wire test signals are transmitted to only the second control switches CS_B, CS_D, CS_F, and defects in the second wires L2, L4, L6, and L8 are detected through light emitting states of the pixels connected to the data lines of the second wires L2, L4, L6, and L8 corresponding to the second control switches CS_B, CS_D, CS_F, and CS_H (S130).

Figure 9:
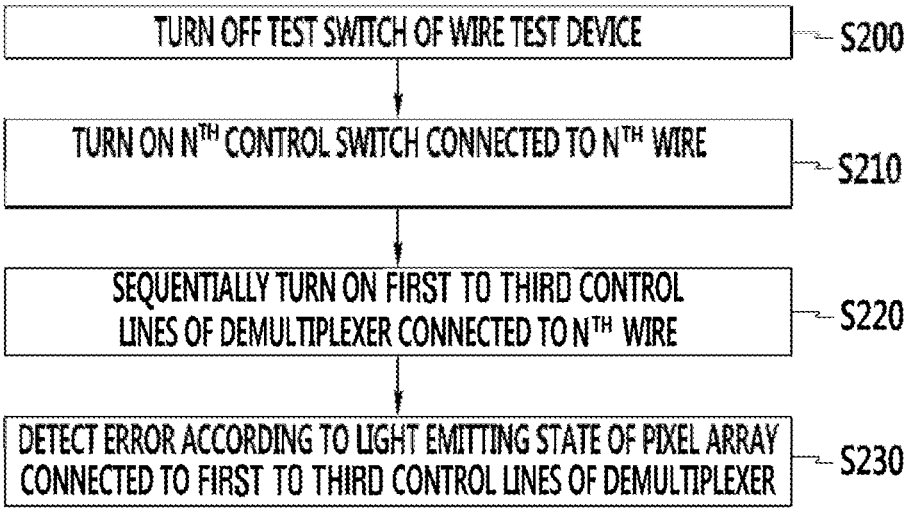
FIG. 9 is a flowchart briefly showing a one-sheet testing operation in accordance with an exemplary embodiment of the present invention.

FIG. 9 is a flowchart showing a one-sheet testing operation in accordance with an exemplary embodiment of the present invention.

A one-sheet test method by which the test device tests an error in the display device will be described as follows. First, the test switch TS of the wire test device 200 is turned off, and probe test data is supplied to the pad 110 of the one-sheet test device (S200).

The test device turns on an $n^{th}$ control switch of the one-sheet test device 100 connected to a $n^{th}$ wire (S210), and the demultiplexing switches sw1 to sw3 connected to the $n^{th}$ wire are sequentially turned on (S220). Then, the test device senses an error according to a light emitting state of a pixel array connected to the sequentially turned-on demultiplexing switches sw1 to sw3 (S230).

The test device turns on an $(n+1)^{th}$ control switch of the one-sheet test device 100 connected to an $(n+1)^{th}$ wire, and the demultiplexing switches sw1 to sw3 connected to the $(n+1)^{th}$ wire are sequentially turned on. Then, the test device senses an error in the display device according to a light emitting state of a pixel array connected to the demultiplexing switches sw1 to sw3 connected to the $(n+1)^{th}$ wire.

The present invention provides a capability of reducing the number of test data lines for testing spider wires and improving its yield rate by configuring the wire test device and the one-sheet test device as one circuit.

The above-described exemplary embodiments can be realized with a program for realizing the configuration of the exemplary embodiments or a non-transitory recording medium for recording the program, in addition to the above-described device and/or method, which is easily realized by a person skilled in the art.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A test device for a display device, comprising:

demultiplexing switches directly connected to pixels through data lines;

a one-sheet test device comprising control switches connected to the demultiplexing switches through wires; and a wire test device configured to transmit wire test signals to a pad connected to the control switches, the test signals detecting defects in the wires, wherein:

the wire test device is configured to transmit the wire test signals to the pad to detect defects in first wires of the wires, and then to detect defects in remaining second wires thereof; and the first wires and the second wires are alternatively disposed below the demultiplexing switches and provide paths for transmitting signals to the demultiplexing switches, each one of the first and second wires being connected to a plurality of the demultiplexing switches.

2. The test device of claim 1, wherein the wire test device comprises:

a test data line configured to supply the wire test signals to the pad connected to the control switches; and a test gate line configured to supply test gate signals to a test switch such that the test switch is turned on or off to selectively transmit the wire test signals to the pad.

3. The test device of claim 2, wherein:

the one-sheet test device comprises a switching driver connected to each of the control switches and configured to turn the control switch on and off by applying voltages to corresponding control switches; and the switching driver alternately turns on and off first control switches, corresponding to the first wires, and second control switches, corresponding to the second wires, when the wires are tested.

4. The test device of claim 3, wherein the first control switches and the second control switches are alternately disposed.

5. The test device of claim 3, wherein, when the test switch is turned on during testing of the wires:

the wire test signals are transferred to the first control switches by turning on the first control switches and turning off the second control switches; and defects in the first wires are detected by detecting light emitting states of pixels connected to data lines of wires corresponding to the first control switches.

6. The test device of claim 5, wherein, when the test switch is turned on during testing of the wires:

the wire test signals are transferred to the second control switches by turning off the first control switches and turning on the second control switches; and defects in the second wires are detected by detecting emitting states of pixels connected to data lines of wires corresponding to the second control switches.

7. The test device of claim 1, wherein:

the control switches comprise:

first control switches connected to corresponding first wires; and second control switches connected to corresponding second wires, and, when one sheet is tested, the demultiplexing switches connected to the first wires are sequentially turned on while the first control switches are turned on, and the demultiplexing switches connected to the second wires are sequentially turned on while the second control switches are turned on.

8. The test device of claim 7, wherein the first control switches and the second control switches are disposed such that one of the first control switches connected to one of the first wires is adjacent to one of the second switches connected to one of the second wires adjacent to the one of the first wires.

9. A one-sheet test method for detecting an error in a display device, the method comprising:

turning off a test switch of a wire test device;

supplying probe test data to a pad of a one-sheet test device;

turning on an $n^{th}$ control switch of the one-sheet test device, which is connected to an $n^{th}$ wire;

sequentially turning on demultiplexing switches connected to the $n^{th}$ wire; and detecting an error by detecting a light emitting state of a pixel array, the pixel array being directly connected to the demultiplexing switches through data lines, wherein a plurality of the demultiplexing switches are connected to the $n^{th}$ wire.

10. The one-sheet test method of claim 9, further comprising:

turning on an $(n+1)^{th}$ control switch of the one-sheet test device, which is connected to an $(n+1)^{th}$ wire; and sequentially turning on demultiplexing switches connected to the $(n+1)^{th}$ wire.

11. The one-sheet test method of claim 9, wherein the probe test data comprise black data.

* * * * *